US005759109A

United States Patent [19]

Martini

[11] Patent Number: 5,759,109

[45] Date of Patent: Jun. 2, 1998

[54] SIMULATED GOLF BALL INSTRUCTIONAL DEVICE

[76] Inventor: Byron Rocco Martini, 4425 W. Haddon Ave., Chicago, Ill. 60651

[21] Appl. No.: 711,252

[22] Filed: Sep. 9, 1996

[51] Int. Cl.[6] ..... A63B 69/36

[52] U.S. Cl. ..... 473/200; 473/281; 273/DIG. 20

[58] Field of Search ..... 473/200, 280, 473/281; 273/199, 200, DIG. 20

[56] References Cited

U.S. PATENT DOCUMENTS 1,262,532 4/1918 McElroy ..... 473/280
3,851,880 12/1974 Ritch ..... 473/280 X

FOREIGN PATENT DOCUMENTS 684827 12/1952 Australia ..... 273/199 R

*Primary Examiner*—George J. Marlo

[57] ABSTRACT

A simulated golf ball instructional device for use in practicing golf strokes which has a central body portion and two end portions. Each end portion has a length measured along the longitudinal axis of the device substantially equal to the radius of a conventional golf ball. The device has an overall length between about three and about five times the radius of a conventional golf ball. Satisfactory, improved and preferred overall lengths are disclosed, with the preferred overall length being substantially four times of radius of a conventional golf ball. One or both ends of the device have a generally hemispherical shape. The device is formed of a resilient, porous plastic open cell foam and is free of any covering skin that would substantially impede or prevent the passage of air from within the foam structure out into the space surrounding the simulated golf ball when a distorting force is applied to the device by a golf club. Several cross-sectional shapes for the central body portion of the device are disclosed, the preferred cross-sectional shape being square. In each case, the minimum transverse dimension of the central portion, measured through the central longitudinal axis of the device, is substantially equal to the diameter of a conventional golf ball.

12 Claims, 2 Drawing Sheets

SIMULATED GOLF BALL INSTRUCTIONAL DEVICE

FIELD OF INVENTION

This invention relates to an instructional device that simulates the form of a golf ball, for use in practicing golf strokes, and to a method of using the same.

BACKGROUND OF INVENTION

For a proper golf stroke off the tee, on the fairway, in a sand trap or in the rough, the player must grasp the club correctly, address the ball with his or her feet, head, arms and body in the correct positions, and swing to strike the ball on the center of the club head with the face of the head meeting the ball essentially perpendicular to the intended initial line of flight of the ball. The stroke must be practiced over and over with each club until the proper stroke becomes a matter of habit. However, the incorrect approach in the early stages of learning the game may produce wrong habits that are difficult to unlearn.

If a driving range, either public or private, is available to the player, the proper swing can be practiced using actual golf balls. However, without the benefit of a professional observing the swing, the player can not know whether the swing is being performed properly. Furthermore, a driving range is not always available, or the weather or lighting conditions prevent the player from using any range that is available.

Various instructional devices have been used to assist the player in practicing and evaluating his or her swing when neither a driving range nor a golf pro is available. Some of these devices can be used only outdoors, while others have the added advantage of being usable in an indoor setting—for example, after dark or during inclement weather.

One of the earliest of such instructional devices is he golf ball substitute for indoor golf disclosed in U.S. Pat. No. 1,293,941 issued to Sargent on Feb. 11, 1919. The method of using the device of that patent involves observation of the point of penetration of a cardboard block (which represents a golf ball) by a pin centered on the face of the golf club. Certain target markings are included on the cardboard object representing the golf ball, and when the pin on the club face pierces one of these markings certain deductions are made from the puncture point position.

Yaggi U.S. Pat. No. 1,881,991 discloses a golf practice device that includes a rectangular mat having a rectangular slot. A target made of flexible sheet rubber that has a circular head that represents a golf ball is mounted on a neck and is supported in the slot. The neck is split into two halves by a slot, each half of the neck having a strip of tin or other material imbedded therein. The neck is inserted in the slot and the neck halves are bent in opposite directions so as to be received within slots in the underside of the mat. This device is said to possess enough resilience to return to an upright position after being struck.

Johnson U.S. Pat. No. 1,922,735 discloses a golf practice device in two embodiments. The first embodiment is simply a pair of circular sections connected by a strip that is stamped out of thin sheet metal or the like. The second embodiment comprises two circular discs. One disc has a pair of tabs that are received by a slot in the other disc and then bent in opposite directions. The discs may be placed at right angles to each other so as to form an upright target.

Stafford U.S. Pat. No. 1,999,513 discloses a golf instructional apparatus comprising a base having sloping side walls that form a channel that receives a tubing. The tubing is made of a flexible resilient material and is substantially as long as the channel formed by the side walls. A leather strip extends out of one end of the tube, and one end of that strip is fastened to a golf ball. When the golf ball is struck, the tubing is forced in the direction of travel of the ball, thus uncovering distance indicators that are located in the bottom of the channel formed by the side walls. Since the apparatus is anchored by a stake, the apparatus will turn in the direction of travel of the golf ball.

Clark U.S. Pat. No. 2,039,633 discloses another golf practice device that includes a ball or target mounted on a flexible stem. Striking the ball with a golf club results in the deformation and elongation of the stem in the direction of flight of the target. The patent further discloses apparatus that is said to provide indications of a hook or slice as well as of distance.

Brown U.S. Pat. No. 2,490,409 discloses a golf practice device comprising a target mounted to a base. The base may take a variety of forms, and includes an attached anchor spike.

Sonnett U.S. Pat. No. 2,656,720 discloses a golf practice apparatus including a golf ball or target mounted to a coil spring secured to an arcuate shell that is attached to a base. A cable is attached to the ball and extends through the coil spring and around a small pulley disposed within the arcuate shell, and then rearwardly around a small pulley, upwardly to a small pulley, and forwardly from there to a distance indicator. Striking the ball results in the distance indicator being moved rearwardly to indicate approximate distance. To indicate the direction of travel of the ball after it is struck, a visual indicator is provided including two lamps each of which is attached to a separate electrical circuit. If the initial direction followed by the ball after it is struck is to the right or left of the line directly forward from the player, the ball will engage a switch lever, thus causing a closed circuit on one or the other side of the apparatus. If the ball is hit on a true line, neither circuit will be closed, resulting in no lamp being illuminated and an indication that the ball was properly hit.

Melin U.S. Pat. No. 2,888,266 discloses a golf practice device that includes a golf ball-shaped target attached to an arm that is engaged at its other end to a support, which includes a pair of spikes by which it may driven into the ground. The support includes a slot that receives a key portion of an arm. The arm is flexible so that it is displaced when the target is struck.

Bahnsen U.S. Pat. No. 3,292,436 teaches a frame supporting a golf ball target. The ball is connected through mechanical means to a revolution counter to provide an indication of distance.

In Chen U.S. Pat. No. 4,441,716, a grid showing directions, distances, and types of clubs is imprinted either on a golf ball or on an object representing a golf ball. A chalked pad is adhesively secured to the club face, so that upon impact with either the actual golf ball or the simulated golf ball a mark is left the center of which falls somewhere within the grid of markings. When the method is used with a simulated golf ball, the simulated ball is formed of highly impact resistant material, such as Delrin or the like.

Vodin U.S. Pat. No. 4,609,197 discloses a golf practice device that includes a golf ball mounted to a shock cord that in turn is secured to the head of a stake. Associated with the apparatus is a distance indicator that includes an indicator slide attached to a helical spring. A cord passes through the center of the spring and is attached to a shock cord such that when the ball is struck by a golf club, the cord will be pulled outwardly, thus moving the distance indicator slide against the spring to provide an indication of distance.

In Weis U.S. Pat. No. 5,451,059, the object that simulates a golf ball is a thin, flat circular object supported on a flexible mounting, which can be rotated into a displaced position that indicates the direction of travel that an actual golf ball would have had when struck. In addition, in a preferred embodiment, the flat surface of the simulated golf ball has an opening in its center with a whistle behind it so that when the flat surface of the club face strikes the simulated ball squarely, air will be driven through the hole to activate the whistle.

All these devices suffer one shortcoming or another. Several are very complicated in construction. Some can not easily be moved from one location to another. One is not reusable over a period of time. And none of them reliably indicates whether the simulated golf ball target is hit squarely by the club face as the player performs his or her practice swing.

SUMMARY OF THE INVENTION

The simulated golf ball instructional device of this invention has a central body portion whose perpendicular cross section is selected from the class consisting of a circle, a regular polygon having at least four sides, and the general shape of an inverted "U." The minimum transverse dimension of the central body portion, measured through the central longitudinal axis of the device, is substantially equal to the diameter of a conventional golf ball. The central body portion extends for at least about one-third of the overall length of the device. This dimension, taken together with the dimensions of the first end portion and the second end portion (stated in the next paragraph) measured along the longitudinal axis of the device, means that the overall length of the device is at least about three times the radius of a conventional golf ball.

The device of this invention has a first end portion that has a generally hemispherical shape, with a radius substantially equal to the radius of a conventional golf ball. As used in this specification and claims, the term "conventional golf ball" means a ball with a dimpled surface that is used in the game of golf played on a course having standard tees, fairways, roughs, sand traps, greens, and cups on the greens, such as a typical public golf course or private country club. The opposite end portion of the device has a length measured along the longitudinal axis of the device that is substantially equal to the radius of a conventional golf ball. It is preferred that this second end portion, like the first end portion, have a generally hemispherical shape.

The preferred cross-sectional shape of the central body portion is substantially a square.

The overall length of the device is no more than about five times the radius of a conventional golf ball. Improved results are obtained when the overall length is about three-and-one-half times to about four-and-one-half times the radius of a conventional golf ball. The preferred overall length of the device is about four times the radius of a conventional golf ball.

A first compression indicator is located on the surface of the device, at the base of the first generally hemispherical end portion, in the plane perpendicular to the longitudinal axis of the device. Second and third compression indicators are preferably located on the surface of the first end portion, in separate planes that are perpendicular to the longitudinal axis of the device and are located at distances from the central body portion substantially equal to one-third and two-thirds, respectively, of the radius of the first end portion. Similar compression indicators are located on the surface of the hemispherical second end portion.

The instructional device of this invention is formed of a resilient, porous plastic foam the pores of which are interconnected throughout the foam to permit air to move without substantial restriction from one portion of the foam to another portion. This foam device is free of any dense exterior covering skin that would substantially impede or substantially prevent the flow of air from within the plastic foam out into the space surrounding the simulated golf ball. The resulting foam structure two important properties. First, it provides little resistance to deformation of the device of this invention under a distorting force from the impact of a golf club swung by the user of the device. Second, after being struck and deformed, the foam returns fully to its original configuration, but only after sufficient time has elapsed to permit the user to retrieve the device and observe the general nature and location of the deformation produced by the impact of the golf club.

ADVANTAGES OF THE INVENTION

The simulated golf ball instructional device of this invention has several important advantages.

- It can be used either out-of-doors or in any suitable indoor setting.
- The device can be carried easily from one location to another.
- It is durable, and can be used a great many times over a given period of time.
- Because of its size and simplicity, a number of the devices can be purchased at any one time.
- The first generally hemispherical end portion presents a target (to be struck by the face of the golf club) that has the general appearance of an actual golf ball.
- At the same time, the rest of the device—including the central body portion and the second end portion, whether of hemispherical shape or not—provides sufficient additional weight resisting the movement of the golf club face that a reliable indication of the angle of the club face to the intended initial direction of the flight of the simulated golf ball is produced.
- Finally, after the simulated golf ball formed of a resilient, porous plastic foam is struck and deformed, and caused to fly forward, the golfer has sufficient time to retrieve and observe the general nature and location of the deformation produced by the impact of the golf club, and thereby to evaluate the orientation of the golf club face at the moment of impact with the simulated golf ball.

DETAILED DESCRIPTION OF SEVERAL EMBODIMENTS

Several embodiments of the simulated golf ball instructional device of this invention, including the best mode contemplated by the inventor, will now be described in some detail by reference to the accompanying drawing.

Figure 1:
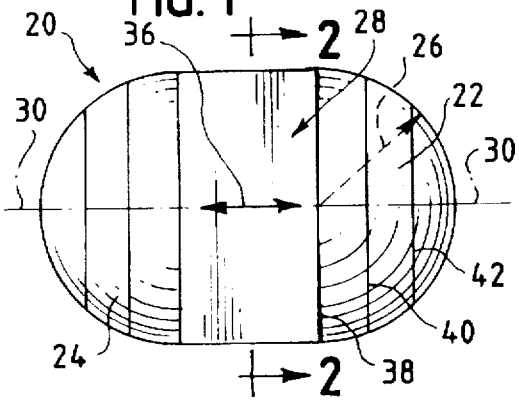
FIG. 1 is a plan view of one embodiment of the simulated golf ball instructional device of this invention, in which the central body portion has a length measured along its longitudinal axis that is substantially equal to the radius of a conventional golf ball.

FIG. 1 shows a top plan view of one embodiment of instructional device 20 in which both first end portion 22 and second end portion 24 are generally hemispherical in shape, each with a radius 26 substantially equal to the radius of a conventional golf ball. Central body portion 28 extends along central longitudinal axis 30 for a distance substantially equal to the radius of a conventional golf ball. As will be seen, the central body portion extends for about one-third of the overall length of the device measured along axis 30. As a result of the dimensions just indicated, the overall length of the device of FIG. 1 is about three times the radius of a conventional golf ball.

Figure 2:
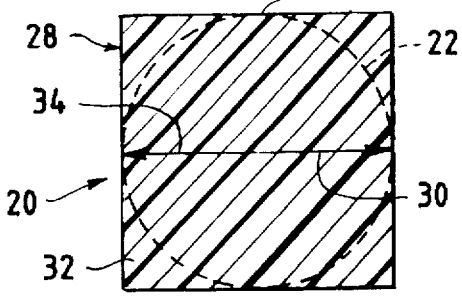
FIG. 2 (on the second sheet of the drawing) is a cross-sectional view of the embodiment of FIG. 1 taken along line 2—2 in the latter Figure.

FIG. 2 (on the second sheet of the drawing) shows a vertical cross section of instructional device 20 of FIG. 1 taken along line 2—2 in the latter Figure. First hemispherical end section 22 is seen in phantom in FIG. 2 behind cross section 32 of central body portion 28. Vertical cross section 32 (perpendicular to longitudinal axis 30) is a regular polygon having four sides. (As used in this specification and the accompanying claims, the term "regular polygon" means a polygon each of whose sides is of equal length.) As will be seen from FIG. 2, minimum transverse dimension 34 of square cross section 32, measured through central longitudinal axis 30 of the device, is substantially equal to the diameter of a conventional golf ball.

Alignment marker 36 extends, for at least a portion of the length of the central body portion, along the top surface of that portion. This alignment marker, in the shape of an arrow having a head at each end, assists the player in lining up the instructional device so that its central longitudinal axis coincides with the intended initial line of flight of the simulated golf ball.

End portions 22 and 24 each carry compression indicators that will disclose whether the golfer swings the club face into the proper position with respect to the stimulated golf ball, and as a result when the simulated golf ball is struck the face of the club head is essentially perpendicular to the intended initial line of flight of the ball. First compression indicator 38 is located on the surface of the device at the base of first end portion 22, in a plane perpendicular to longitudinal axis 30. Second and third indicators are lines located on the surface of end portion 22, in separate planes that are perpendicular to longitudinal axis 30. The planes in which indicators 40 and 42 lie are located at distances from central body portion 28, and thus from first indicator 38, that are substantially equal to one-third and two-thirds, respectively, of the radius of hemispherical end portion 32. End portion 24 carries a set of three similarly located compression indicators.

As already mentioned, the device of this invention is formed of a resilient, porous plastic foam. (This foam is described in more detail below in connection with FIG. 13.) The foam is distorted, upon being struck by the face of a golf club, in a manner that reflects the position of the golf club at the moment of impact. The foam retains the deformation for a brief time, long enough to permit the golfer to retrieve the device after it is struck by the golf club and observe the general nature and location of the deformation (in relation to the central longitudinal axis of the device) that was produced by the impact of the club on the simulated golf the ball. The golfer can tell from the observed deformation whether he or she has struck the simulated golf ball with the face of the golf club properly oriented.

The simulated golf ball then returns fully to its original configuration, and can be used repeatedly for further practice by the golfer.

Figure 3:
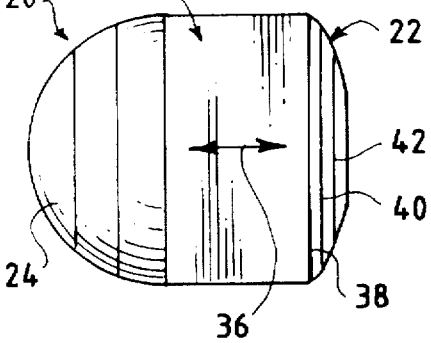
FIG. 3 is a plan view of the embodiment of FIG. 1 after the device has been struck by a golf club with the face of the club meeting the ball essentially perpendicular to the intended initial line of flight of the ball.
Figure 4:
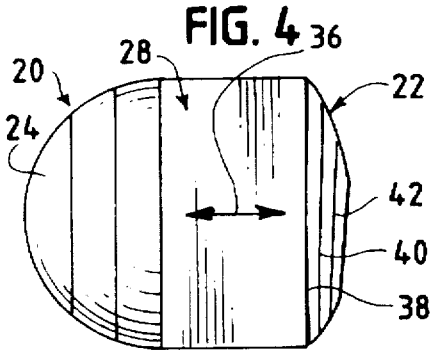
FIG. 4 is a plan view of the embodiment of FIG. 1 after the device has been struck by the golf club with the face of the club being turned slightly to the right as it meets the ball instead of being essentially perpendicular to the intended initial line of flight of the ball.
Figure 5:
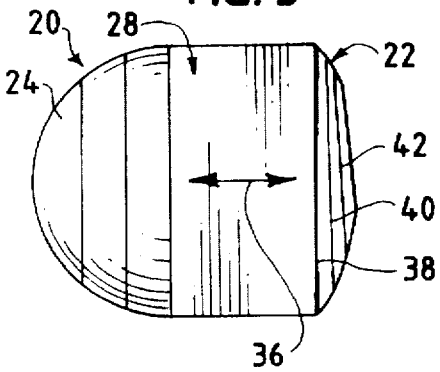
FIG. 5 is a plan view of the embodiment of FIG. 1 after the device has been struck by the golf club with the face of the club being turned slightly to the left as it meets the ball instead of being essentially perpendicular to the intended initial line of flight of the ball.

Observation of the deformation produced by impact from the face of the golf club will tell the player whether he or she has in fact swung the club so as to strike the simulated golf ball portion of the device with the face of the club essentially perpendicular to the intended initial line of flight of the ball. FIG. 3 is a plan view of the type of deformation produced by such a correct swing. FIGS. 4 and 5 are plan views showing the deformation caused by the face of the club head when it is turned somewhat to the right or left so that the club fails to meet the ball with the face in a position perpendicular to the initial line of flight of the ball. FIG. 4 shows the relative positions of compression indicators 38, 40 and 42 after the club face has struck first end portion 22 of the simulated golf ball with the face of the club turned slightly to the right as it hits the ball. FIG. 5 shows the relative positions of compression indicators 38, 40 and 42 after the club face has struck the ball turned slightly to the left as it meets the ball. In actual practice, the indicated deformation may be greater than is shown in FIGS. 3–5.

Figure 6:
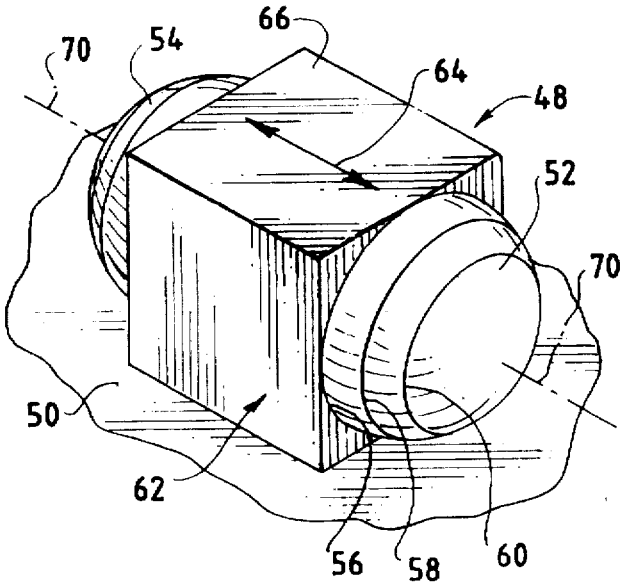
FIG. 6 is an isometric three-quarters view of a preferred embodiment of the device of this invention in which the central body portion has the shape of a cube.

FIG. 6 is an isometric three-quarters view of the preferred embodiment 48 of the instructional device of this invention, resting on support surface 50. (The support surface may be grass or bare ground when the instructional device is used out-of-doors, or a mat of rubber or carpeting when it is used indoors, or any other suitable surface.) In this embodiment, end portions 52 and 54 have the same form and dimensions as end portions 22 and 24 of the embodiment of FIG. 1. First end portion 52 includes compression indicators 56, 58 and 60, which are similar in location and function to the compression indicators of the first embodiment described above. Second hemispherical end portion 54 carries similar indicators.

Central body portion 62 has the shape of a cube each side of which is equal in length to substantially twice the radius of a conventional golf ball. Alignment marker 64 is positioned on top surface 66 of central body portion 62, parallel to central longitudinal axis 70 of the device.

Figure 7:
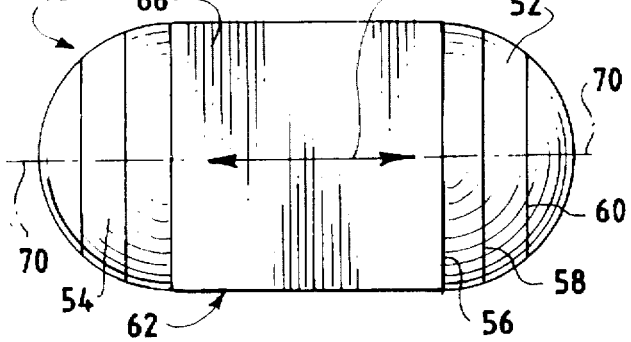
FIG. 7 is a plan view of the embodiment of FIG. 6.

FIG. 7 is a plan view of the embodiment illustrated in FIG. 6.

The instructional device shown in FIGS. 6 and 7 is the preferred embodiment of this invention for several reasons. Central body portion 62 has sufficient mass that it will, together with second end portion 72, provide a force that will effectively oppose the force from the impact of the club face and thereby squeeze first end portion 52 into crumpled shapes similar to end portions 22 and 23 in FIGS. 3, 4 and 5 described above. Central body portion 62 is not, however, so large that it will detract from the appearance of the simulated golf ball to any substantial degree. With the length of the central body portion limited to no more than twice the radius of a conventional golf ball, the device will not be awkward to handle. Moreover, this embodiment is short enough that it will fly quite reliably along a trajectory similar to the initial path followed by an actual golf ball struck by a golf club. The bottom of this embodiment has a substantial surface area, and as a result the simulated golf ball will be held steady on whatever surface it is placed upon. Alignment marker 66 is long enough that it emphasizes clearly the direction of the intended initial flight of the simulated golf ball.

Other suitable shapes for the central body portion of the device of this invention are illustrated in FIGS. 8–9, 10 and 11–12. Instructional device 80, shown in FIG. 8, has hemispherical end portions 82 and 84, at each end of central body portion 86, which is hexagonal in cross section. The top wall of central body portion 86 carries alignment marker 88. As seen in cross section in FIG. 9 (on the second sheet of the drawing), bottom wall 90 of the central body portion provides a flat surface to hold the device steady on the support surface on which it is placed to be struck with a player's practice swing. Central body portion 86 lies between hemispherical end portions 82 and 84. End portion 82 is shown in phantom in FIG. 9. As will be seen, the minimum transverse dimension 92 of hexagonal cross section 86, measured through central longitudinal axis 94 of the device, is substantially equal to the diameter of a conventional golf ball.

Figure 10:
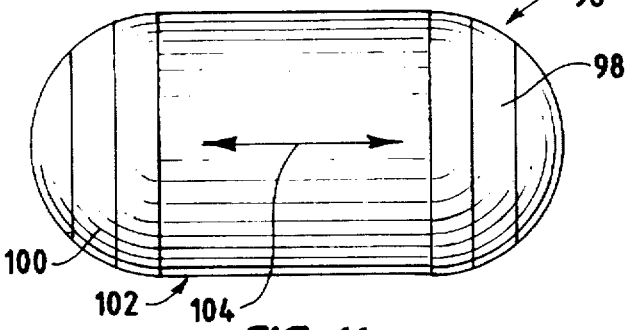
FIG. 10 is a plan view of an embodiment of the device of this invention in which the central body portion has a circular cross section.

FIG. 10 illustrates another embodiment 96 of the instructional device of this invention. First end portion 98 and second end portion 100 have the same hemispherical shape and dimensions as in the other embodiments, each end section simulating one-half of an actual golf ball. Central body portion 102 is circular in cross section. In use, this embodiment is placed on the supporting surface with alignment marker 104 on top, where it can be seen by the player.

The cylindrical form of central body portion 102 blends smoothly into hemispherical end portions 98 and 100, which is more consistent with the appearance of a simulated golf ball. In some situations, however, the cylindrical bottom half of the central body portion may make it more difficult to make certain that the alignment marker 104 is reliably centered across the top surface of the simulated golf ball.

Figure 11:
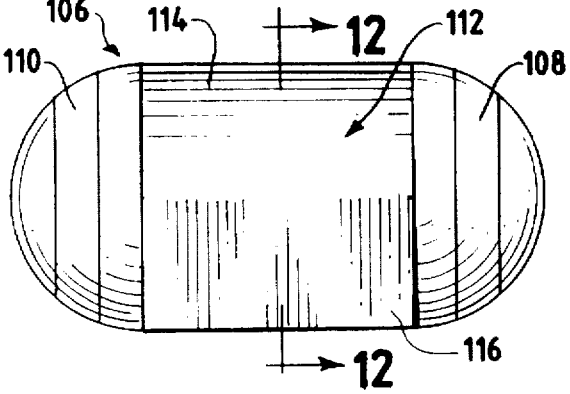
FIG. 11 is a side elevation of another embodiment of the instructional device of this invention in which the central body portion has a cross section in the general shape of an inverted "U"
Figure 12:
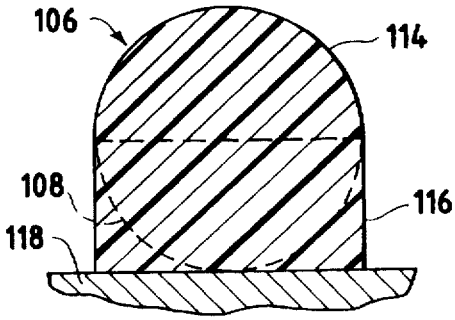
FIG. 12 is a cross-sectional view of the embodiment of FIG. 11 taken along the line 12—12 in the latter FIG.

FIG. 11 provides a side elevation, and FIG. 12 provides a cross section, of another embodiment 106 of the instructional device of this invention. First end portion 108 and second end portion 110 simulate the two hemispherical halves of a golf ball. Top half 114 of the central body portion is cylindrical in shape, while bottom half 116 has the cross-sectional shape of half a square. Because of this construction, the top surface of this embodiment blends into the two hemispherical shapes at each end of the device, while the rectilinear bottom half 116 of the central body portion ensures reliable placement of the instructional device on support surface 118.

Figure 13:
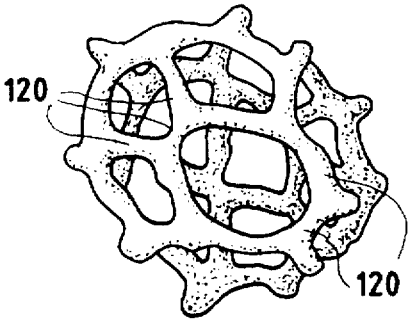
FIG. 13 is a fragmentary perspective view of a portion of the polyurethane open cell foam of which the instructional device of this invention is formed.
Figure 8:
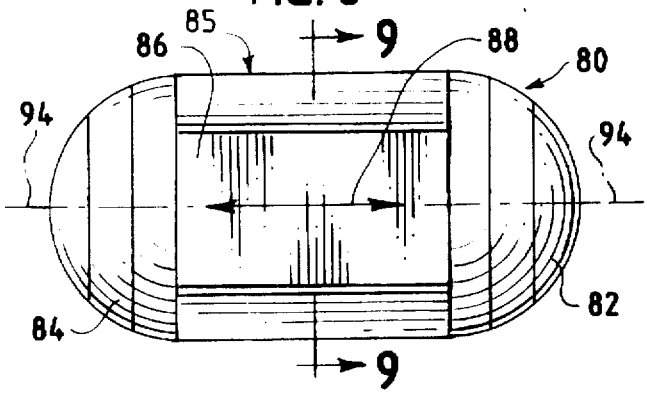
FIG. 8 is a plan view of another embodiment of the device of this invention in which the central body portion has an hexagonal cross section.

As indicated in the greatly enlarged view of FIG. 13, the preferred material of which the instructional device of this invention is formed is a polyurethane open cell foam material composed of randomly distributed, flexible, resilient, interconnected strands 120. These strands of plastic form a three-dimensional structure of openings or pores, which structure is free of any dense outer covering membrane or skin that would impede the free flow of air, and in the extreme case substantially prevent the flow of any air, from within the plastic foam out into the space surrounding the simulated golf ball. In other words, this foam device is free of any dense outer skin surrounding a foamed core, such as is present in items customarily referred to as "structural foam" products.

Figure 9:
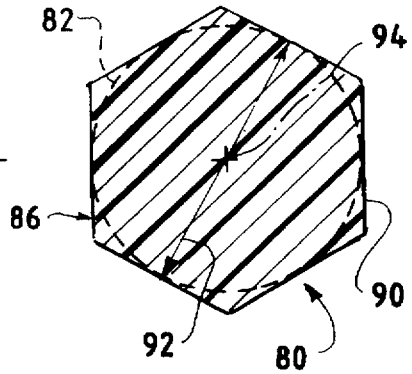
FIG. 9 (on the second sheet of the drawing) is a cross-sectional view of the embodiment of FIG. 8 taken along line 9—9 in the latter Figure.

As will be seen from the accompanying drawing, especially from FIGS. 2, 9, and 12, the interior spaces defined by the outermost surfaces of said central body portion, first end portion and second end portion are substantially filled with the plastic open cell foam.

The random arrangement of the pores eliminates straight channels through this material, and at the same time permits air to flow readily therethrough from one portion of the foam to another portion, thereby providing little resistance to deformation of the device under a distorting force from the impact of a golf club. As will be apparent to a skilled worker in the field of plastics, substantially all the resistance to such a distorting force will be provided by the resilient strands themselves, and not by frictional resistance between the air and the cellular structure as the air is expelled from the pores by the force applied by the golf club. While the pores are not precisely the same size, they are predominantly within a range of similar sizes so that the air flow therethrough is substantially uniform throughout.

The open cell foam permits the travel of air from one portion of the block to another without any substantial restriction such as would occur with conventional closed cell foams. The simulated golf ball therefore acts as if it is filled with air, with the foam providing little resistance to deformation but providing the force for always returning the device to its original configuration.

To manufacture the instructional device of this invention in commercial quantities, a sheet of the open cell polyurethane foam of suitable thickness is first produced, and rectilinear blocks of appropriate dimensions are cut from the sheet. The desired shape is then cut from each such block, using cutting equipment well known in the art of shaping foam plastic objects of various forms.

While this invention has been described in connection with the best mode presently contemplated by the inventor for carrying out his invention, the preferred embodiments described and shown are for purposes of illustration only, and are not to e construed as constituting any limitation of the invention. Modifications will be obvious to those skilled in the art, and all modifications that do not depart from the spirit of the invention are intended to be included within the scope of the appended claims.

I claim:

1. A simulated golf ball instructional device for use in practicing golf strokes which comprises:

an elongated object having:

(a) a central longitudinal axis extending throughout the length of the elongated object;

(b) a central body portion, the cross section of said central body portion perpendicular to said axis being selected from the class consisting of (i) a circle, (ii) a regular polygon having at least four sides, and (iii) the general shape of an inverted "U,"

the minimum transverse dimension of said central body portion, measured through the central longitudinal axis of the device, being substantially equal to the diameter of a conventional golf ball, said central body portion extending for about one-third to about three-fifths of the overall length of the elongated device measured along said longitudinal axis, said overall length being no more than about five times the radius of a conventional golf ball;

(c) a first end portion having a generally hemispherical shape, with a radius substantially equal to the radius of a conventional golf ball; and (d) a second end portion at the opposite end of the device from said first end portion, said second end portion having a length measured along said longitudinal axis that is substantially equal to the radius of a conventional golf ball;

said device being formed of a resilient, porous plastic open cell foam comprising randomly distributed, flexible, resilient, interconnected strands of plastic arranged to form a three-dimensional porous structure:

the pores of which structure are interconnected throughout the foam to permit air to move without substantial restriction from one portion of the foam to another portion, that is free of any exterior covering skin that would impede the free passage of air from within the structure out into the space surrounding the simulated golf ball, that provides resistance to deformation of the device, under a distorting force from the impact of a golf club, substantially only from the interconnected strands of plastic themselves, and that after being thus struck and deformed returns fully to its original configuration only after sufficient time has elapsed to permit the user to retrieve the device and observe the general nature and location of the deformation, in relation to the central longitudinal axis of the device, that was produced by the impact of the golf club, the space defined by the outermost surfaces of said central body portion, first end portion and second end portion being substantially filled with said plastic open cell foam.

2. An instructional device according to claim 1 in which the central body portion has a circular cross section.

3. An instructional device according to claim 1 in which the central body portion has a hexagonal cross section.

4. An instructional device according to claim 1 in which the central body portion has a square cross section.

5. An instructional device according to claim 4 that has an overall length of about three-end-one-half times to about four-and-one-half times the radius of a conventional golf ball.

6. An instructional device according to claim 5 that has an overall length of about four times the radius of a conventional golf ball.

7. An instructional device according to claim 1 in which the central body portion has an inverted "U"-shaped cross section.

8. An instructional device according to claim 1 in which an alignment marker, in the shape of an arrow having a head at each end, extends along the surface of at least a portion of the length of said central body portion in a direction parallel to the longitudinal axis of the device.

9. An instructional device according to claim 1 in which a first compression indicator in the form of a visible line is located on the surface of the device, in a plane perpendicular to said longitudinal axis of the device, at the base of said first generally hemispherical end portion.

10. The instructional device of claim 9 in which second and third compression indicators in the form of visible lines are located on the surface of said first generally hemispherical end portion, in separate planes that are perpendicular to said longitudinal axis and are located at distances from said central body portion that are substantially equal to one-third and two-thirds, respectively, of the radius of said first generally hemispherical end portion of the device.

11. The instructional device of any of claims 1, 4, 8 and 10 in which said second end portion has a generally hemispherical shape with a radius substantially equal to the radius of a conventional golf ball.

12. A simulated golf ball instructional device for use in practicing golf strokes which an elongated object having:

(a) a central longitudinal axis extending throughout the length of the elongated object;

(b) an overall length measured along said central longitudinal axis equal to about four times the radius of a conventional golf ball;

(c) a central body portion in the shape of a cube each side of whose transverse cross section has a length substantially equal to the diameter of a conventional golf ball, said central body portion extending for about one-half of the overall length of the elongated device measured along said longitudinal axis;

(d) a first end portion having a generally hemispherical shape, with a radius substantially equal to the radius of a conventional golf ball;

(e) a second end portion at the opposite end of the device from said first end portion, said second end portion having a generally hemispherical shape, with a radius substantially equal to the radius of a conventional golf ball;

(f) an alignment marker that extends along the surface of at least a portion of the length of said central body portion in a direction parallel to said longitudinal axis of the device;

(g) first compression indicators in the form of visible lines located on the surface of the device at the base of each of said first and second generally hemispherical end portions; and (h) second and third compression indicators in the form of visible lines located on the surface of each of said first and second generally hemispherical end portions, in separate planes that are perpendicular to said longitudinal axis and are located at distances from said central body portion substantially equal to one-third and two-thirds, respectively, of the radius of said first and second generally hemispherical end portions of the device, said device being formed of a resilient, porous plastic open cell foam comprising randomly distributed, flexible, resilient, interconnected strands of plastic arranged to form a three-dimensional porous structure:

the pores of which structure are interconnected throughout the foam to permit air to move without substantial restriction from one portion of the foam to another portion, that is free of any exterior covering skin that would impede the free passage of air from within the structure out into the space surrounding the simulated golf ball, that provides resistance to deformation of the device, under a distorting force from the impact of a golf club, substantially only from the interconnected strands of plastic themselves, and that after being thus struck and deformed returns fully to its original configuration only after sufficient time has elapsed to permit the user to retrieve the device and observe the general nature and location of the deformation, in relation to the central longitudinal axis of the device, that was produced by the impact of the golf club, the space defined by the outermost surfaces of said central body portion, first end portion and second end portion being substantially filled with said plastic open cell foam.

* * * * *